US006634108B2

(12) United States Patent
Lüttgens

(10) Patent No.: US 6,634,108 B2
(45) Date of Patent: Oct. 21, 2003

(54) SHARPENER FOR SHARPENING A SOFT-CORE PENCIL

(75) Inventor: Fritz Lüttgens, Erlangen (DE)

(73) Assignee: KUM Limited, Dublin (IE)

( * ) Notice: Subject to any disclaimer, the term of this patent is extended or adjusted under 35 U.S.C. 154(b) by 25 days.

(21) Appl. No.: 10/062,939

(22) Filed: Jan. 31, 2002

(65) Prior Publication Data

US 2003/0014870 A1 Jan. 23, 2003

(30) Foreign Application Priority Data

Jul. 19, 2001 (DE) ..... 201 11 956 U

(51) Int. Cl.[7] ..... B43L 23/00

(52) U.S. Cl. ..... 30/454; 30/453; 30/457; 30/459; 144/28.11

(58) Field of Search ..... 30/451, 453, 454, 30/457, 459; 144/28.11; 7/160

(56) References Cited

U.S. PATENT DOCUMENTS

| | | | | |
|---|---|---|---|---|
| 2,513,704 A | | 7/1950 | Arant | |
| D219,065 S | * | 10/1970 | Zelnick | |
| 3,961,450 A | * | 6/1976 | Knaell | |
| 4,197,649 A | | 4/1980 | Flinn | |
| 6,334,256 B1 | * | 1/2002 | Luttgens | 30/454 |
| 6,397,479 B1 | * | 6/2002 | Luttgens | 30/454 |

FOREIGN PATENT DOCUMENTS

| | | |
|---|---|---|
| CH | 551 885 | 7/1974 |
| DE | 868 565 | 1/1953 |
| DE | 41 43 297 A1 | 6/1993 |
| DE | 199 55 395 A1 | 9/2000 |
| EP | 0 872 356 A1 | 10/1998 |
| JP | 10 264 592 A | 10/1998 |

* cited by examiner

*Primary Examiner*—Hwei-Siu Payer
(74) *Attorney, Agent, or Firm*—Laurence A. Greenberg; Werner H. Stemer; Gregory L. Mayback

(57) ABSTRACT

A sharpener, in particular for a soft-core pencil, has a sharpener housing with a sharpener channel that opens out into a free space via a channel opening. The sharpener has a sharpener blade that is positioned tangentially against the channel opening. The invention provides a magnifying glass for optically enlarging a core formation in the region of the channel opening and/or in the free space.

8 Claims, 5 Drawing Sheets

SHARPENER FOR SHARPENING A SOFT-CORE PENCIL

BACKGROUND OF THE INVENTION

Field of the Invention

The invention relates to a sharpener, in particular to a sharpener for sharpening a soft-core pencil. The sharpener has a sharpener housing that can be inserted into a sharpener container, a sharpener channel that opens out into a free space via a channel opening, and a sharpener blade positioned tangentially against the sharpener channel.

A sharpener having a pencil or core sharpener, a sharpener container enclosing the sharpener, a base part, and a cover is known, for example, from Published German Patent Application DE 199 55 395 A1. This type of sharpener is referred to as a container-type sharpener. The pencil or core sharpener in this document forms the actual sharpener body, which is usually molded in one piece from plastic and has a guide channel that tapers conically in the introduction direction. The guide channel is for accommodating the front end of the pencil or core that is to be sharpened. A sharpener blade retained on the sharpener body is positioned tangentially against the guide channel.

A sharpener with a corresponding sharpener body or sharpener housing is also known from Published European Patent Application EP 0 872 356 A1. A cleaning stick, which is retained in a captive and removable manner on or in the sharpener housing, is provided for cleaning accumulating core substance out of the sharpener body. This accumulating core substance which tends to smear, in particular in the vicinity of the sharpener blade and/or a shaving rib provided for shaping a soft core.

In the case of such a sharpener, in particular in the case of a cosmetics sharpener, it would be advantageous to be able to individually configure adapted core formations. It is often intended to achieve specific line contours using drawing pencils or cosmetics pencils. In particular in decorative cosmetics, for example, applying line contours on the eyes and lips or applying the cosmetic over the surface of the lips and cheeks in cream or powder form are/is required. For this purpose, it is desirable to be able to monitor the shaping during the configuration of the core.

SUMMARY OF THE INVENTION

It is accordingly an object of the invention to provide a sharpener which overcomes the above-mentioned disadvantages of the prior art apparatus of this general type.

In particular, it is object of the invention to provide a sharpener, in particular, a sharpener housing and a cleaning stick such that the operation of shaping the core can be monitored in a straightforward and particularly effective manner. For this purpose, a magnifying glass is provided as a constituent part of the sharpener. The magnifying glass allows optical enlargement of the core formation during the intended use of the sharpener.

With the foregoing and other objects in view there is provided, in accordance with the invention, a sharpener that includes a sharpener container, and a sharpener housing that is inserted into the sharpener container. The sharpener housing is formed with a free space. The sharpener also includes: a sharpener channel having a channel opening that opens into the free space; a sharpener blade positioned tangentially against the sharpener channel; and a magnifying glass for optically enlarging a core formation positioned either near the channel opening or in the free space.

In accordance with an added feature of the invention, the magnifying glass is an integral component of the sharpener housing.

In accordance with an additional feature of the invention, the sharpener housing has a longitudinal side; and the magnifying glass is configured in the longitudinal side of the sharpener housing.

In accordance with another feature of the invention, the magnifying glass is an integral component of the sharpener container.

In accordance with a further feature of the invention, the sharpener container has a cover; and the magnifying glass is configured in the cover.

In accordance with a further added feature of the invention, the sharpener includes a retaining tongue having a free end attached to the magnifying glass; the retaining tongue is articulated on the cover of the container; the sharpener housing is formed with an introduction opening that opens out into the sharpener channel; and the magnifying glass is pivotable to cover the introduction opening.

In accordance with a further additional feature of the invention, the sharpener includes a cleaning stick that is removably retained in the sharpener housing, and the magnifying glass is an integral component of the cleaning stick.

In accordance with yet an added feature of the invention, the sharpener blade is constructed for sharpening a core of a pencil; and the sharpener channel is constructed for receiving the pencil.

The magnifying glass is expediently an integral constituent part of the sharpener. For this purpose, the magnifying glass may be integrated in a sharpener container or in the sharpener housing (sharpener body). A connecting piece integrally formed on the sharpener housing is suitable for arranging the magnifying glass on the sharpener housing or in the sharpener body. The connecting piece is located in the region above or beneath the sharpener blade and thus in the region where the sharpener channel opens out into the free space. In the case of a cosmetics sharpener, usually an additional core shaper in the form of a specially shaped shaving edge is configured in the region where the sharpener channel opens out into the free space. It is also possible, however, to introduce the magnifying glass into a longitudinal side of the sharpener housing or sharpener body, with the result that it is possible to monitor the core shaping from a lateral viewpoint.

If the sharpener includes a sharpener container, the magnifying glass can be introduced into or formed in, the container cover. It is also possible, however, to introduce the magnifying glass in the container base, which usually serves as a shavings collector. In addition, the magnifying glass may also be provided at the free end of a tongue that is retained in a pivotable manner on the cover of the sharpener container. In this embodiment, the magnifying glass, when not in use, advantageously covers the introduction opening for the pencil that is to be sharpened. The introduction opening is provided on the front side of the sharpener housing or body. In this embodiment, the magnifying glass thus also serves as a closure element for the introduction opening.

Since, in the case of a soft-core sharpener, there is usually a cleaning stick, which is retained in a captive but removable manner in a holding receptacle of the sharpener housing, it is also possible for the magnifying glass to be integrated into the cleaning stick, preferably into the head region thereof.

One of the advantages obtained by the invention is that by using a magnifying glass to optically enlarge the shaping region of the sharpener, it is possible to reliably monitor the operation of shaping the core. The magnifying glass may be an integral or separate component retained in a captive manner in or on the sharpener. In the case of a container-type sharpener, integrating the magnifying glass in the sharpener container is particularly suitable, while, in the case of a sharpener without a container, integrating the magnifying glass in a side wall of the housing or in a retaining connecting piece integrally formed on the sharpener housing is particularly suitable. The retaining connecting piece then expediently runs between the two longitudinal sides of the housing, and at the same time, above the sharpener channel or the location at which the latter opens out into the free space. It is also possible for the sharpening housing itself to be configured as a magnifying glass, with the result that the magnifying glass is then integral with the molded sharpener.

Other features which are considered as characteristic for the invention are set forth in the appended claims.

Although the invention is illustrated and described herein as embodied in a sharpener, in particular for a soft-core pencil, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
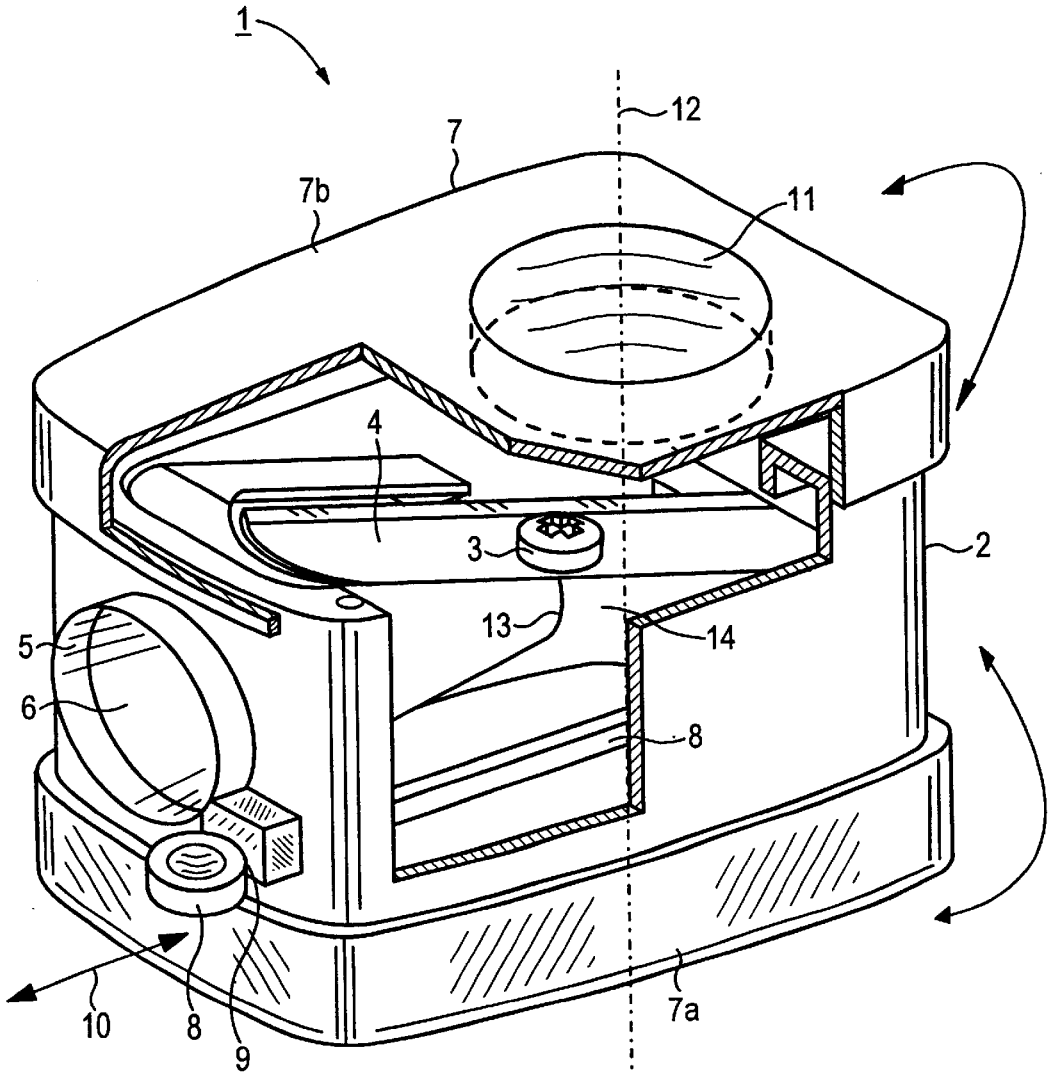
FIG. 1 is a perspective view of a container-type sharpener having a sharpener housing and a sharpener container with an integrated magnifying glass.

Parts that correspond to one another are provided with the same designations in all of the figures. Referring now to the figures of the drawing in detail and first, particularly, to FIG. 1 thereof, there is shown a sharpener 1 that includes a sharpener housing 2, which is also referred to hereinbelow as a sharpener body, and which is cuboidal in the exemplary embodiment shown. The sharpener 1 has a sharpener blade 4, fastened on by a screw 3, and an introduction opening 5 that opens out into a sharpener or guide channel 6 for the pencil that will be sharpened. The sharpener 1 also includes a sharpener container 7 with a bottom part or container base 7*a* and a top part or container cover 7*b*. The container base 7*a* and the container cover 7*b* may be connected to one another, in a manner that is not specifically illustrated, by a film hinge on a rear narrow side of the sharpener container 7. The sharpener container 7 preferably consists of transparent plastic.

The sharpener body or housing 2 also preferably consists of plastic, but may also consist of metal, for example. A cleaning stick 8 is arranged in a captive manner in a holding receptacle 9 in the sharpener body or housing 2. As indicated by the double arrow 10, the cleaning stick 8 can be removed from the sharpener body or housing 2.

The sharpener channel 6 has a channel opening 13 that opens into a free space 14 at which the core of the pencil (not illustrated) will be shaped. In the embodiment shown in FIG. 1, a magnifying glass 11 is integrated into the container cover 7*b*. The magnifying glass 11 is arranged such that the axis 12 of the magnifying glass 11 is in the free space 14 at which the core of the pencil will be shaped. It can be seen that the axis 12 of the magnifying glass 11 is arranged downstream from the channel opening 13, with respect to the insertion direction of a pencil. This arrangement of the magnifying glass 11 allows the region of the sharpener 1, in which the operation of shaping the core takes place, to be optically enlarged. This allows the shaping of the respective core of a cosmetics or drawing pencil to be suitably monitored.

Figure 2:
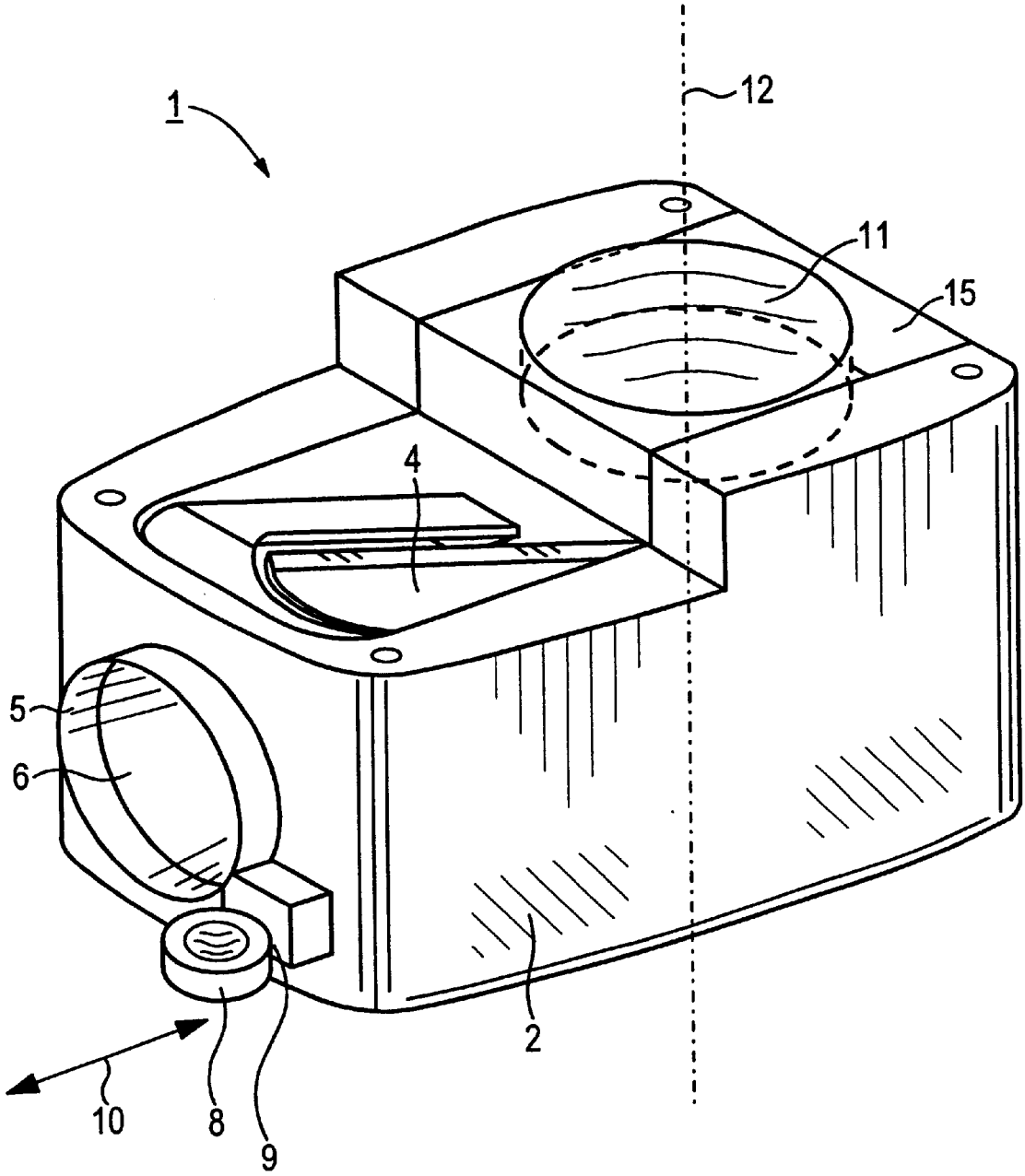
FIG. 2 is a perspective view of a sharpener with a magnifying glass integrated into a housing connecting piece.

FIG. 2 shows a further embodiment of a sharpener 1 without a container. The magnifying glass 11 is integrated above the sharpener blade 4 in a housing or retaining connecting piece 15 that is preferably integrally formed on the sharpener housing 2. The top side of the sharpener blade 4 is directed away from the guide channel 6 In this embodiment, the axis 12 of the magnifying glass 11 also runs in or through the free space 14 and runs transversely to the insertion direction of the pencil that will be shaped, and thus transversely to the axis of the sharpener channel 6. It is possible for the distance between the axis 12 and the channel opening 13 to be smaller or greater than that shown in the illustrations, and in practice this distance can be zero. The essential factor in configuring the magnifying glass 11 is to ensure that the magnifying glass 11 defines the region of the core formation as sharply as possible and has the highest possible level of optical enlargement.

Figure 3:
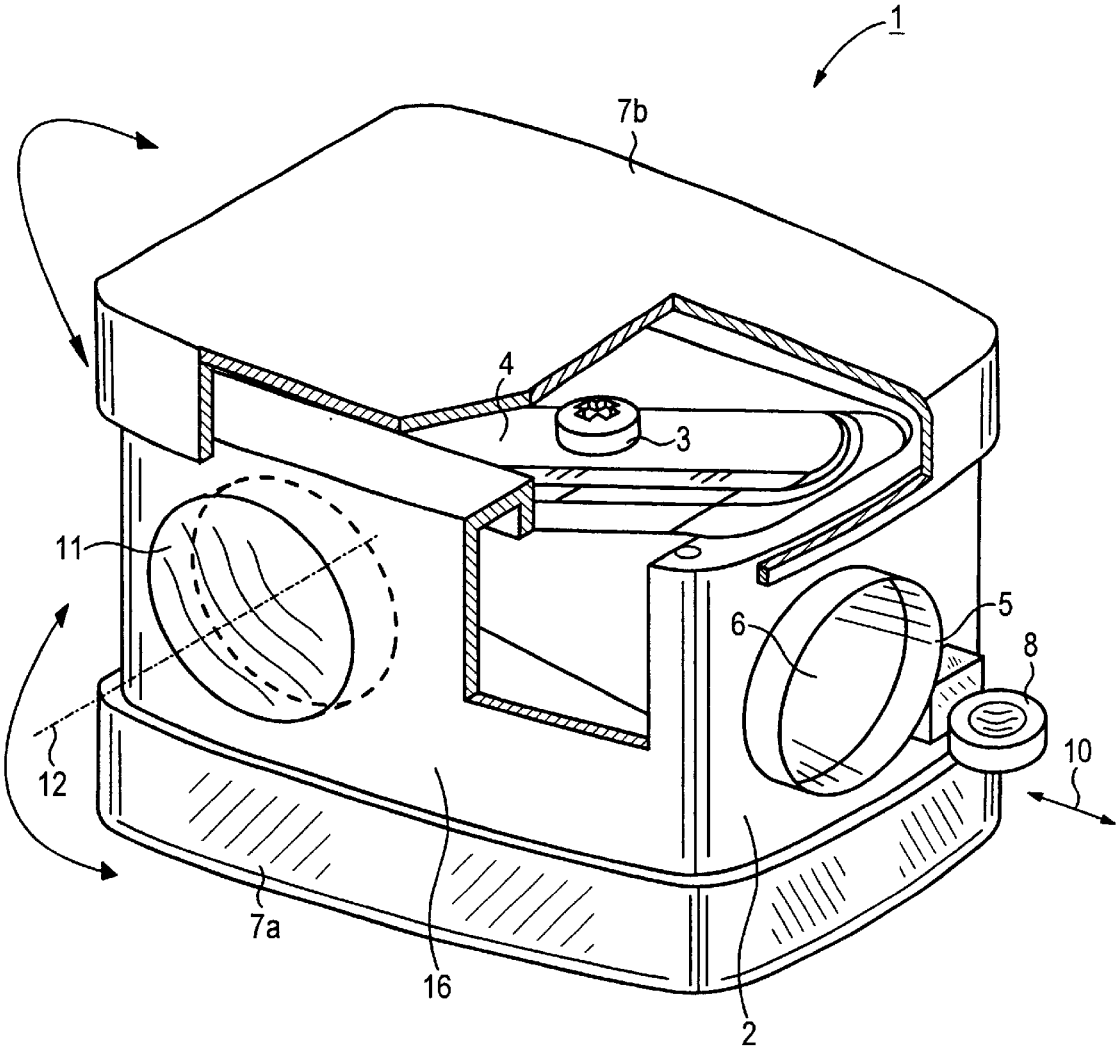
FIG. 3 is a perspective view of an embodiment corresponding to that shown in FIG. 1, except that the magnifying glass has been integrated into a longitudinal side of the housing of the sharpener.

FIG. 3 shows an embodiment of the sharpener 1 in which the magnifying glass 11 has been integrated into a longitudinal side or wall 16 of the sharpener housing 2. In this embodiment, the axis 12 of the magnifying glass 11 is also located in the free space 14 in the region of the opening 13 of the guide channel 6.

Figure 4:
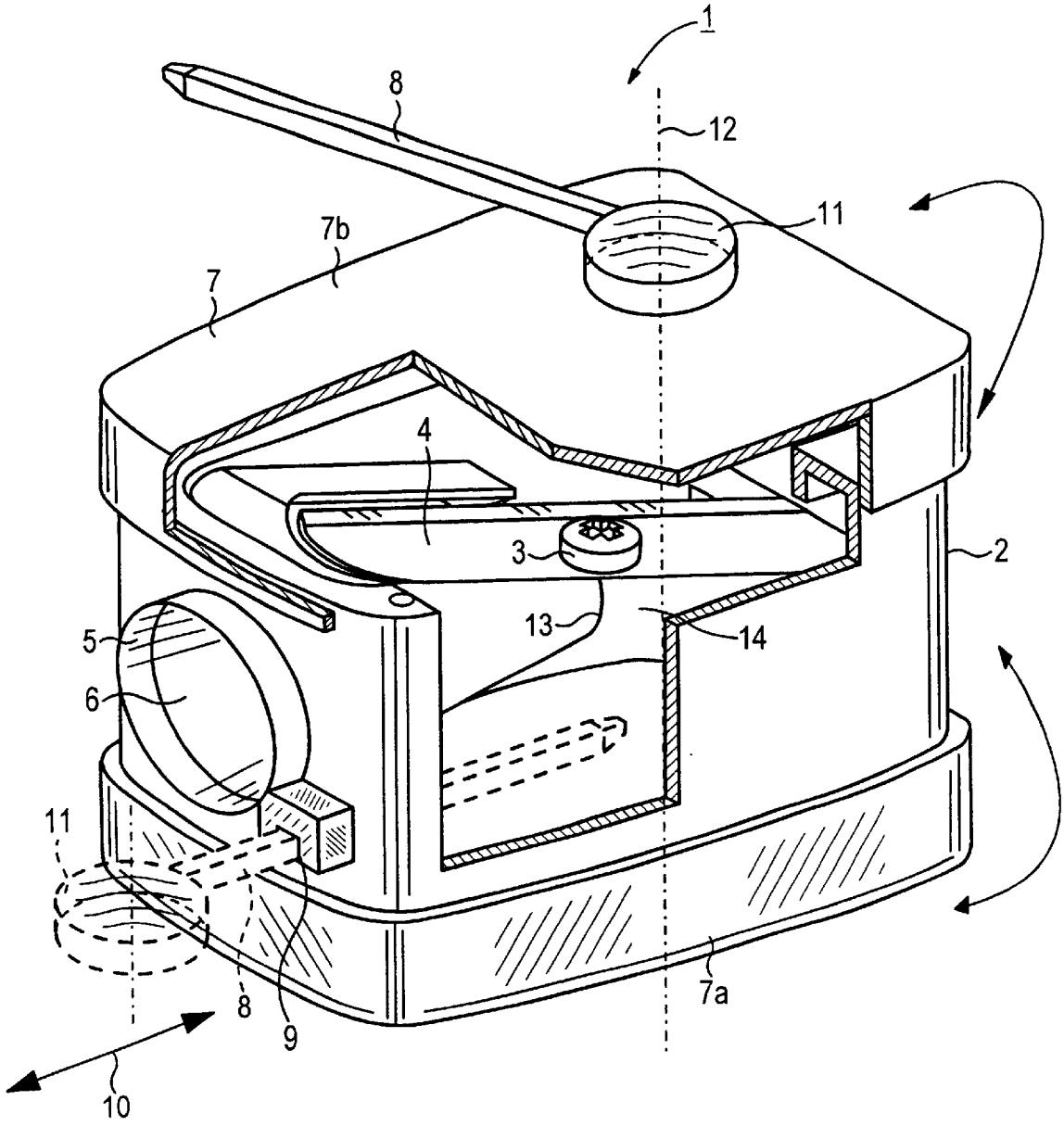
FIG. 4 is a perspective view of an embodiment corresponding to that shown in FIG. 1, except that the magnifying glass has been integrated into the cleaning stick.

FIG. 4 shows an embodiment of the sharpener 1 in which the magnifying glass 11 has been integrated into the cleaning stick 8. The magnifying glass 11 preferably forms the head of the cleaning stick 8. When the cleaning stick 8 is inserted into the holding receptacle 9, the head is located outside of the sharpener housing 2. The cleaning stick 8 is illustrated by dashed lines to show the position of the cleaning stick 8 when the cleaning stick 8 has been inserted into the sharpener housing 2. To optically enlarge the region of the core formation, the cleaning stick 8 is removed from the sharpener housing 2 and—as illustrated—is retained in a corresponding position above the free space 14 and/or the channel opening 13.

Figure 5:
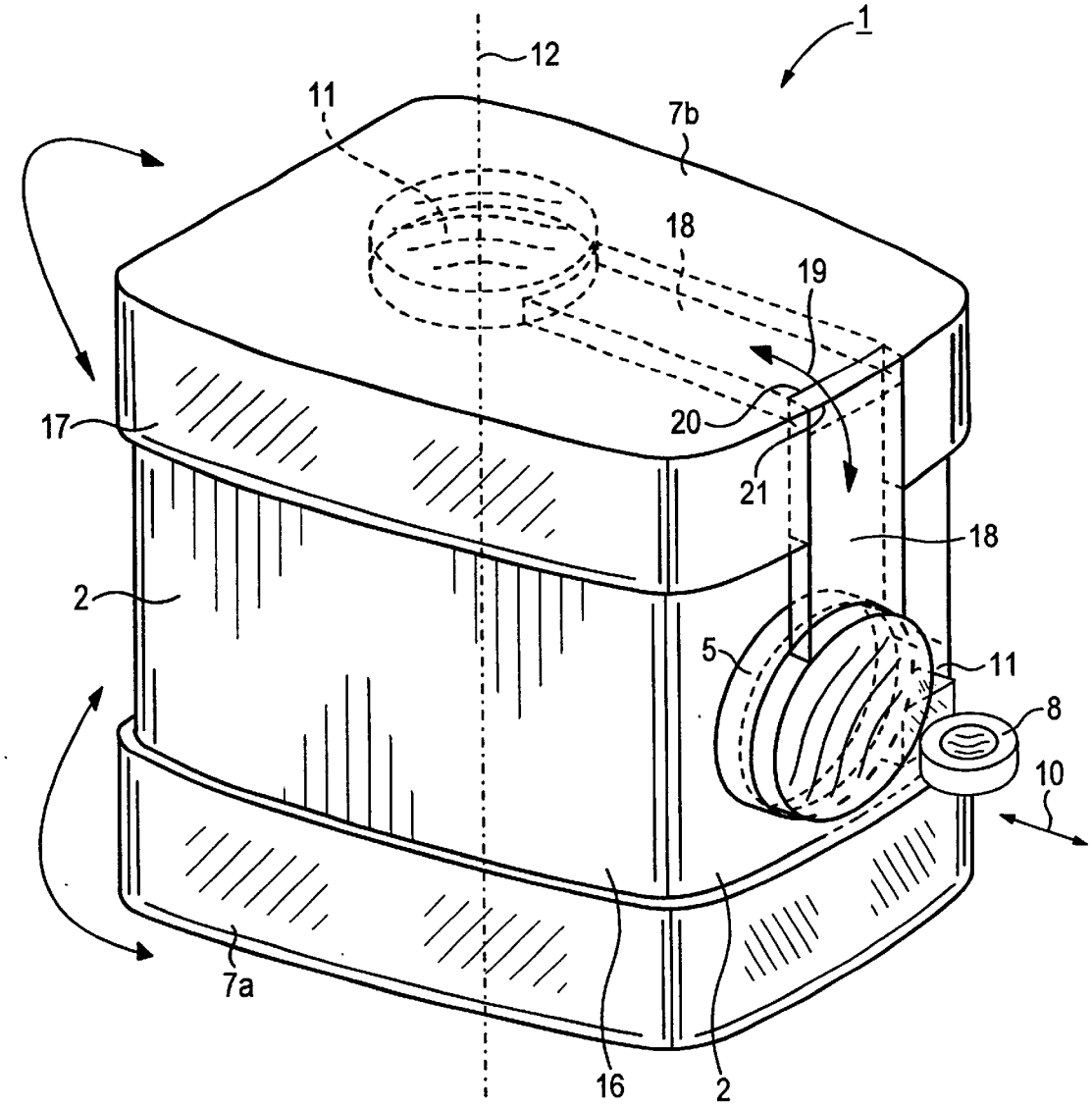
FIG. 5 is a perspective view of an embodiment corresponding to that shown in FIG. 1, except that the magnifying glass is retained in a pivotable manner on the container cover.

FIG. 5 shows a container-type sharpener 1 in which the magnifying glass 11 is retained in a pivotable manner on the container cover 7*b*. For this purpose, a region of the peripheral wall 17 of the container cover 7*b* that is located above the introduction opening 5 is cut out to form a lug-like retaining tongue 18. The retaining tongue 18 has an end bearing the magnifying glass 11. The length of the retaining tongue 18 is dimensioned such that the magnifying glass 11, which, is retained at the end of the retaining tongue 18 covers the introduction opening 5 in the initial state, which is illustrated. In this position, the magnifying glass 11 closes off the introduction opening 5 by engaging or latching into the introduction opening 5, preferably with a form fit.

In order to use the magnifying glass 11, the magnifying glass 11 is pivoted in the pivoting direction 19 and is thus moved into the position depicted by the dashed lines. In this case while being used as intended, the axis 12 of the magnifying glass 11 is once again located in the free space 14 in the region of the guide channel 6. The pivotable mounting of the retaining tongue 18, bearing the magnifying glass 11, is preferably realized by a film hinge 20 that is provided along the top edge 21 of the container cover 7*b*. The top edge runs in the region of the cutout formed by the retaining tongue 18.

I claim:

1. A sharpener, comprising:

a sharpener container;

a sharpener housing inserted into said sharpener container, said sharpener housing formed with a free space;

a sharpener channel having a channel opening that opens into said free space;

a sharpener blade positioned tangentially against said sharpener channel; and a magnifying glass for optically enlarging a core formation positioned at a location selected from the group consisting of near said channel opening and in said free space.

2. The sharpener according to claim 1, wherein said magnifying glass is an integral component of said sharpener housing.

3. The sharpener according to claim 2, wherein:

said sharpener housing has a longitudinal side; and said magnifying glass is configured in said longitudinal side of said sharpener housing.

4. The sharpener according to claim 1, wherein said magnifying glass is an integral component of said sharpener container.

5. The sharpener according to claim 4, wherein:

said sharpener container has a cover; and said magnifying glass is configured in said cover.

6. The sharpener according to claim 5, comprising:

a retaining tongue having a free end attached to said magnifying glass;

said retaining tongue being articulated on said cover;

said sharpener housing formed with an introduction opening that opens out into said sharpener channel; and said magnifying glass being pivotable to cover said introduction opening.

7. The sharpener according to claim 1, comprising:

a cleaning stick removably retained in said sharpener housing;

said magnifying glass being an integral component of said cleaning stick.

8. The sharpener according to claim 1, wherein:

said sharpener blade is constructed for sharpening a core of a pencil; and said sharpener channel is constructed for receiving the pencil.

* * * * *